United States Patent [19]

Baitz

[11] 4,363,229

[45] Dec. 14, 1982

[54] RECEPTACLE FOR PAPER CURRENCY, COINS AND THE LIKE

[75] Inventor: Guenter Baitz, Berlin, Fed. Rep. of Germany

[73] Assignee: Nixdorf Computer AG, Paderborn, Fed. Rep. of Germany

[21] Appl. No.: 121,846

[22] Filed: Feb. 15, 1980

[30] Foreign Application Priority Data

Feb. 27, 1979 [DE] Fed. Rep. of Germany ..... 2907643

[51] Int. Cl.[3] ..... E05B 47/00

[52] U.S. Cl. ..... 70/279; 70/87; 70/159

[58] Field of Search ..... 70/87, 159–162, 70/279, 282; 312/333, 215; 194/1 F

[56] References Cited

U.S. PATENT DOCUMENTS

| | | | |
|---|---|---|---|
| 647,126 | 4/1900 | Winter | 70/159 |
| 3,200,623 | 8/1965 | Peters | 70/279 |
| 4,066,308 | 1/1978 | Wedel | 312/333 |
| 4,268,076 | 5/1981 | Itoi | 70/279 X |

*Primary Examiner*—William E. Lyddane

*Attorney, Agent, or Firm*—Krass, Young & Schivley

[57] ABSTRACT

A cash register tray for currency and coins having its own pivotal cover and lock whereby the tray can also be used as a portable cash box. A spring and electromagnet within the tray itself control opening and closing functions.

8 Claims, 5 Drawing Figures

RECEPTACLE FOR PAPER CURRENCY, COINS AND THE LIKE

INTRODUCTION

The invention relates to a receptacle for paper currency, coins, and the like, especially a money receptacle for cash registers, with an electrically and manually actuatable opening device, which comprises a locking arrangement acting on one part of the receptacle as well as a spring arrangement acting on this part in the opening direction.

BACKGROUND OF THE INVENTION

The usual cash registers generally have as their money receptacle a drawer which if necessary is provided with a special removable insert and can be pushed into the cash register against the force of a spring arrangement. This drawer is opened either manually or electrically, by moving a locking bar out of a locking position, so that the spring arrangement can push the drawer out of the cash register.

This principle is also used in the modern electronic cash registers, which if necessary may be connected with a data processing unit, and for example, are used in the cash registers of self-service stores and supermarkets. The money receptacles of such cash registers have special requirements to meet, since on the one hand they must operate reliably and dependably and be secure against thievery, and on the other hand after they are emptied it must not be possible to close them until the next business day. Besides this, in view of ergonomic considerations the simplest and easiest operation is striven for, which insures operation without fatigue.

SUMMARY OF THE INVENTION

In connection with a solution of this problem, considerations arose the result of which consists in moving the money receptacle out of the cash register proper, so that thereby a separate casing is required which in conformity with the simplest possible manipulation of the cash register is to be accommodated separately and only electrically connected with the latter.

Thus the invention is based on the newly posed problem of supplying a construction for a receptacle for paper currency, coins and the like which will satisfy the above-mentioned principle and will lead to an arrangement which is suitable for adoption universally, that is, not only for direct connection with a cash register but also, for example, for use as a portable safety cash box.

A receptacle of the kind mentioned above for the solution of this problem is characterized according to the invention by a box-like casing, the cover surface of which is constructed as a swinging cover and forms the above-mentioned receptacle part, by a closing device which is accessible from the outside of the receptacle and is coupled with the opening device arranged in the receptacle, and by an electromagnet device arranged in the receptacle and connected with the opening device and to which electromagnet device on opening signal can be fed.

A receptacle according to the invention, in contrast to the previously known money receptacles, is not connected from the outside with the spring arrangement and with the opening device, but rather the opening device and the spring arrangement as well as the electromagnet device are accommodated in the receptacle. This results in an integral object with smooth surfaces on all sides, which can particularly advantageously be used as a separate money receptacle in connection with cash registers. This requires only an electrical connection between the cash register and the electromagnet device provided in the receptacle. This connection can be achieved in a very simple way by way of an electrical plug device of a known type. Moreover, the closing device can be actuated from the outside of the receptacle with a key, as is the case for example, with cash boxes. Since the opening device is connected with the closing device on the one hand and with the electromagnet device on the other hand, a particularly simple construction of the opening mechanism results, since the latter because of its connection with the closing device need execute only rotary motions, which can also be brought about with an electromagnet relatively simply.

Because only the hinged cover and not the whole receptacle need be moved for opening, a comparatively weak spring arrangement can be provided for opening the swinging cover. This situation is made more favorable still when, according to a further development of the invention, an oblong blocklike casing is provided in the longitudinal direction of which is arranged the axis of rotation for the swinging cover. Since the swinging cover then has a relatively small width transversely to its axis of rotation, a comparatively small force is required to swivel it up into the opening position.

A further improvement as well as an acceleration of the opening motion is possible when the swinging cover during its opening motion can sink at least partially into the casing and moreover is mounted unstably. This means that the stable positions of the swinging cover are the open position and the closed positions. If the swinging cover is unlocked for the opening, the spring arrangement need only lightly strike against it in order for it to reach its second stable position.

For the mounting described, the swinging cover suitably shows bearing flanges bent at a right angle on their narrow sides, which flanges serve as rotary elements and are each mounted pivoting on one side wall of the casing in such a way that the distance between the pivot points and the casing bottom approximately corresponds to their distance from the rear wall. In this way it is managed that the swinging cover reaches an approximately vertical position in its open position, and thereby the torque produced by its weight, which is operating in its opening motion, is determined by the distance between the pivot points and the swinging cover.

As has already been stated, the invention makes possible an especially simple construction of the opening device. For this purpose the receptacle contains a cylindrical bolt arranged in a side wall of the receptacle, the part of which projecting into the receptacle is a support for a swivel locking bar which is flexibly thrust into a locking position, catches by its hook-shaped bar section on a projection provided on the swinging cover, is coupled with the electromagnet device at its actuating lever section and can be swiveled into an opening position by the actuation of the electromagnet device as well as by the rotation of the closing cylinder against the spring tension.

Thus, this involves a single element acting as a swivel locking bolt, which is mounted directly onto the body of the cylindrical bolt. The closing cylinder can be provided with a hook-shaped element of a known type, with which it acts on the swivel locking bolt and brings this into the opening position against the spring tension. The same motion can be produced by the electromagnet device. This motion need only be done in pulses, in order to release the projection provided on the swinging cover, so that the swinging cover can automatically swivel into its open position.

The requirement of remaining continually open when the cash register is empty, which is often imposed on money receptacles of cash registers, can easily be fulfilled with a receptacle according to the invention by providing an operating lever which rotates the swivel locking bar into the opening position against the spring tension, which lever is locked against any swiveling motion by an additional element inserted into the casing, preferably an insert fitting the inner space of the casing. If the insert is taken out of the receptacle, then the operating lever brings the swivel locking bar into its opening position, in which it is retained by the operating lever long enough until the additional element is again inserted into the casing. This locking of the operating lever can obviously be achieved by a similar measure, for example, by an additional lock accessible from the outside.

The operating lever is suitably acted on in the operating direction by a spring, the tension of which is greater than the spring tension thrusting the swivel locking bar into the locking position. This insures a reliable retention of the operating lever in its position corresponding to a continual opening of the receptacle.

The electrical connection between the receptacle and the cash register can, as already mentioned, be achieved by way of a plug arrangement. An especially advantageous further development consists in having the electromagnet unit contain a driving circuit which can be controlled by the opening signal, with a capacitor as current source for an electromagnet connected with the locking arrangement. Through this further development it is managed that the power leads for the electromagnet device must have a comparatively small cross section, since the electromagnet need not be actuated by a current pulse which is fed over these power feeds, but rather it need have fed to it only an actuating signal which brings about a discharge of the capacitor by way of the electromagnet. The charging of the capacitor can take place between separate opening actions with a comparatively longer time constant and thus with a low current strength.

BRIEF DESCRIPTION OF THE DRAWINGS

An embodiment example of the invention is described in the following on the basis of the figures. In these.

DETAILED DESCRIPTION OF A SPECIFIC EMBODIMENT

Figure 1:
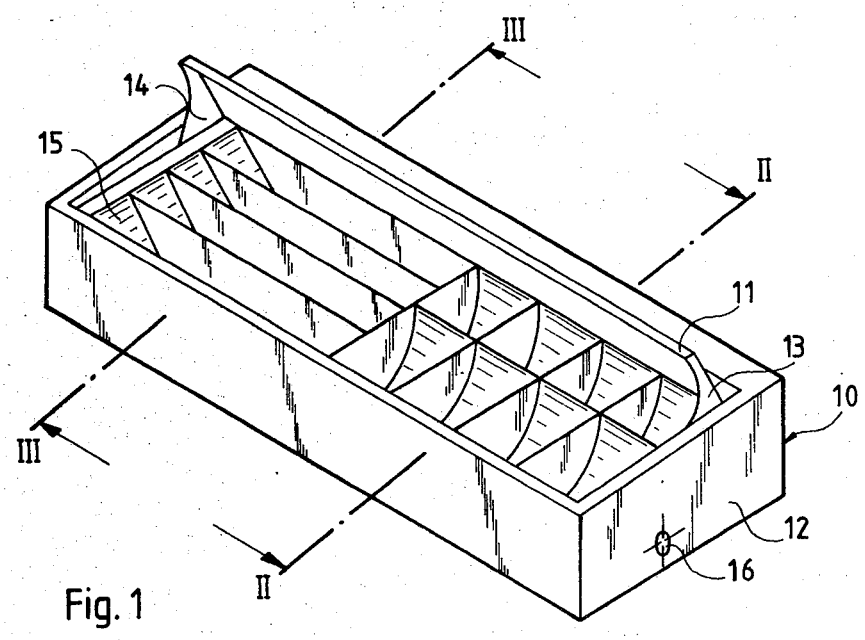
FIG. 1 shows a receptacle according to the invention in a perspective representation.

FIG. 1 shows a perspective representation of a receptacle 10 which is constructed oblong and blocklike. This receptacle 10 has as its cover surface a swinging cover 11, which is connected with the casing 12 on the two bearing flanges 13 and 14 in a manner which is not represented. The casing 12 and the swinging cover 11 may for example, be fabricated from sheet iron. Moreover, they can advantageously consist of plastic.

FIG. 1 shows that in the receptacle 10 is arranged as an additional element, which is constructed as an insert 15 for paper currency and coins. Inserts of this kind are known in themselves. As is to be described later, the insert 15 in the present case has a special function which influences the function of the opening device.

On a side wall of the casing 12 is provided a bolt 16 with which the receptacle 10 can be opened. The opening device required for this is built into the receptacle 10 and will be described in the following.

Figure 2:
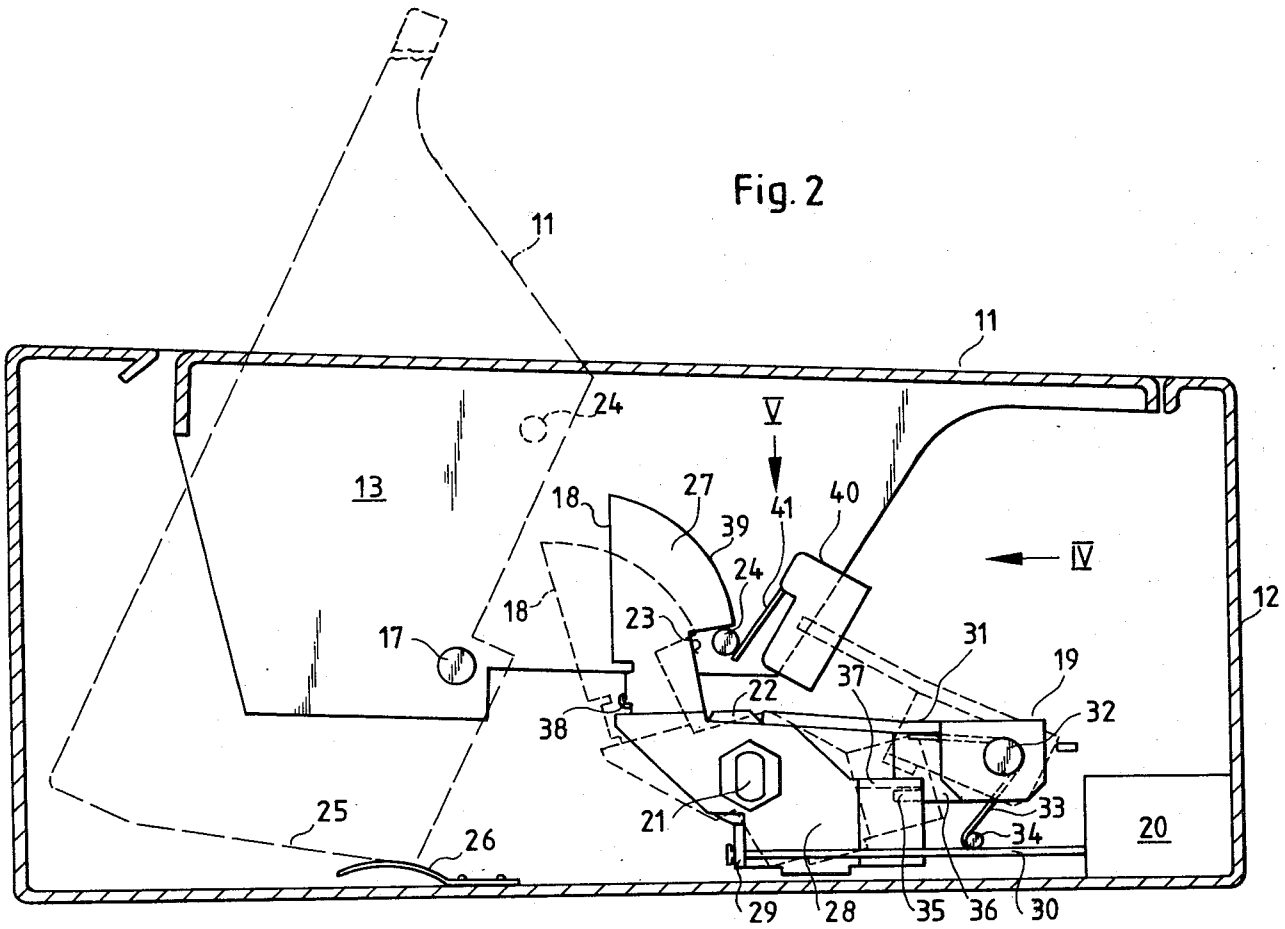
FIG. 2 shows the section 2—2 according to FIG. 1.

FIG. 2 shows the section 2—2 according to FIG. 1. The hinged cover 11 is drawn in solid lines in its closed position, on the upper side of the casing 12. The open position is shown in broken lines. The motion from the closed position into the open position is executed around a pivot point 17, which for example, may be a pivot pin inserted in the side wall of the casing 12, which pin is passed through a corresponding bored hole in the bearing flange 13.

The open mechanism comprises as its essential parts a swivel locking bar 18, an actuating lever 19 and an electromagnet device 20. The electromagnet device 20 is indicated only diagrammatically in FIG. 2, and its electrical connection by way of a plug arrangement with an apparatus provided outside of the casing 12, for example a cash register, is not represented, since connections of this kind can be provided at any desired positions in the casing 12.

The swivel locking bolt 18 rests on the cylindrical part of a cylindrical bolt 16 (FIG. 1), which is built into the side wall of the casing, as represented in FIG. 1. In FIG. 2, all that can be seen of the cylindrical bolt is only the outer end of the closing cyinder 21, which by its rotation swivels a hook-shaped extension 22 in a manner not represented, so that the latter can move the swivel locking bar 18 mounted on the cylinder part into the open position shown in broken lines in FIG. 2. In this position the swivel locking bar 18 releases from its catch groove 23 a projection 24 which is fastened to the bearing flange 13 of the swinging cover 11. Through the spring arrangement shown in FIG. 2, the swinging cover 11 is pushed upward, so that by reason of its unstable mounting it is swiveled around the pivot point 17 and reaches the position shown in broken lines in FIG. 2, in which the rear edge 25 of the bearing flange 13 acts on a leaf spring 16 fastened onto the bottom of the casing 12, in such a way that the hinged cover 11 is arrested in its open position shown in FIG. 2.

The movement of the swivel locking bar 18 into the open position shown in broken lines in FIG. 2 can be brought about not only on the bolt section 27 but also on a section of the operating lever 28. For this the section of the operating lever 28 is coupled at 29 with the tie rod 30 of the electromagnet device 20. If the electromagnet inside the electromagnet device 20 receives a current pulse, then the tie rod 30 moves to the right with respect to the representation in FIG. 2, whereby the operating lever section 28 of the swivel locking bar 18 is pulled accordingly and the swivel locking bar 18 is swiveled counterclockwise (FIG. 2) in the manner described.

Also shown in FIG. 2 is an operating lever 31, which is pivoted at 32 on the side wall of the casing. It is thrust into the position shown in broken lines in FIG. 2, by means of a spring 33, one end of which is fastened onto the side wall of the casing at 34, and the other end of which acts on the bottom side of its lever arm. If an added insert is present in the casing 12, however, then this insert thrusts the operating lever 31 into the position represented in solid lines in FIG. 2. In this position there is a lateral catch 35 which is provided on a flange 36 of the operating lever 31, under a laterally bent arm 37 on the actuating lever section 28 of the swivel locking bar 18. If the actuating lever 31 is now released by the removal of the insert described above from the casing 12 and 13 brought by the spring 33 into the position represented in broken lines in FIG. 2, then with its catch 35 it takes along the laterally bent arm 37 of the swivel locking bar 18, so that the swivel locking bar 18 is thereby also swiveled into the open position represented in broken lines in FIG. 2. It remains in this position until the insert is again inserted into the casing 12.

It should be mentioned here that the swivel locking bar 18 is thrust by spring tension into the position represented in solid lines in FIG. 2. For this a spiral spring can be provided which encircles the body of the cylindrical bolt 16. In FIG. 2 only the end of this spiral spring can be seen at 38. The force of this spiral spring must be less than the force of the spring 33 which swivels the operating lever 31, thus assuring that the open position of the swivel locking bar 18 as achieved by the operating lever 31 is maintained until the locking lever 31 has again been returned to its position of rest.

The actuating lever 31 fulfills the requirement usually imposed on money receptacles, namely that the receptacle remain open when it is emptied after a business day. It is true that by rotating the cylindrical bolt 16 (FIG. 1) the swivel locking bar 18 could again be brought into its closed position, but after the release of the bolt it would immediately be moved back by the operating lever 31 into its open position, on which way the open position is maintained.

As is seen in FIG. 2, the swivel locking bar 18 is provided on its locking section with a curved edge 39 which is so arranged that with manual pressure on the open swinging cover 11, the projection 24 reaches the curved edge and is conducted past it. If the swivel locking bar 18 is located in its closed position which is represented in solid lines, then by the manual closing motion of the swinging cover 11 it is brought into the position represented in broken lines until the projection 24 of the swinging cover 11 catches in the catch groove 23. In order to facilitate this conducting of the projection 24 on the curved edge, it is advantageous for the projection 24 to be provided with a guide roller, which is not represented in detail in FIG. 2.

Also represented in FIG. 2 is a microswitch 40 with an operating arm 41, which can be activated by the projection 24 of the hinged cover 11. This microswitch 40 is connected, in a manner not represented, with a lead wire which leads to the outside of the receptacle and, for example, feeds a signal to a cash register assigned to it which yields the opening of the swinging cover 11. By way of the cash register a signal can then be given to the person operating it that a closing of the swinging cover 11 is required after the next cashier's action has taken place.

Figure 3:
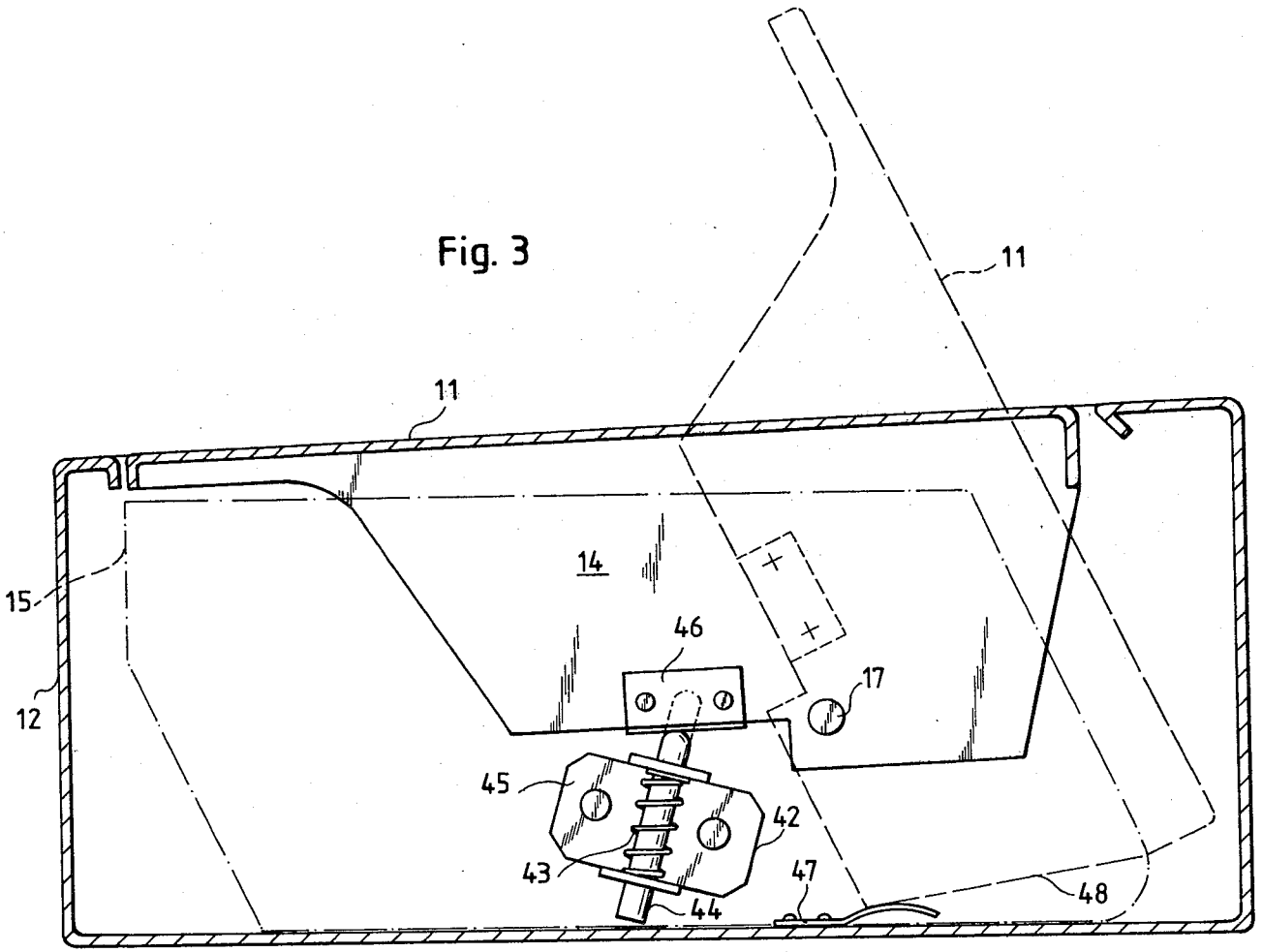
FIG. 3 shows the section 3—3 according to FIG. 1.

FIG. 3 shows the section III—III according to FIG. 1. On the side wall of the casing is fastened a spring arrangement 42 which comprises a pressure spring 43 and a thrust bolt 44 which is mounted movably in a holder 45. The thrust bolt 44 acts on an angle plate 46 fastened on the under edge of the bearing flange 14. If the swinging cover 11 is unlocked with the opening device shown in FIG. 2, then the thrust bolt 44 pushes the bearing flange 14 upward, whereby the swinging cover 11 reaches its open position in the manner described by rotating around its pivot point 17. On this side of the casing 12 is also provided a leaf spring 47 which, like the leaf spring 26 (FIG. 2) acts on the rear edge 48 of the bearing flange 14 and has the function already described.

In FIG. 3 the contour of the insert 15 is represented in a dot-dash line, which insert, as shown in FIG. 1, can be provided with leaves for receiving paper money and coins. This contour is adapted to the movement of the swinging cover 11 in such a way that there is sufficient room available for the latter in the rear section of the casing 12.

Figure 4:
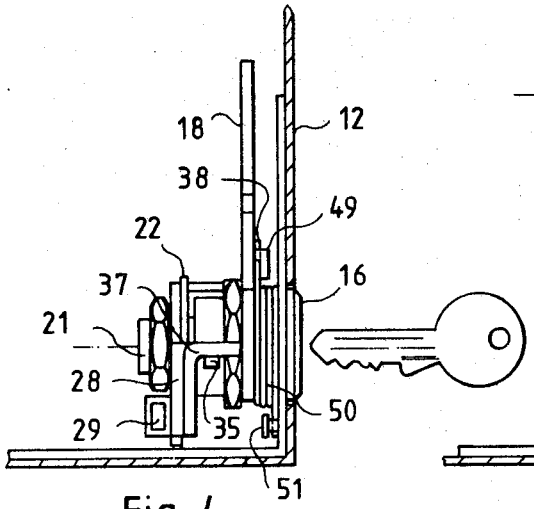
FIG. 4 shows a view of the opening device according to the direction of view 4 shown in FIG. 2.

FIG. 4 shows a view of the opening device according to the direction of view IV in FIG. 2. The casing 12 is only partially represented. Moreover, the operating lever 31 (FIG. 2) is not shown for a better recognition of the individual parts.

The cylindrical bolt 16 carries on its cylindrical part the swivel locking bar 18, on the right side of which can be seen the anchor 49 of the spring 50, which surrounds the cylindrical part. One end of this spring lies on a projection of the swivel locking bar 18 which forms the anchor 19. The other end of the spring 50 is anchored at 51 on the side wall of the casing. In this manner the swivel locking bar 18 is thrust into the position shown in solid lines in FIG. 2.

FIG. 4 also shows the connection point 20 on the operating lever section 28 of the swivel locking bar 18. Moreover the bent arm 37 is shown which is acted on from below by the catch 35 of the operating lever 31, which is not represented. Finally it may be noted that the hook-shaped projection 22, which transmits the closing motion of the cylinder 21 to the swivel locking bar 18, is arranged between the operating lever section 28 and the cylindrical part of the cylindrical bolt 16.

Figure 5:
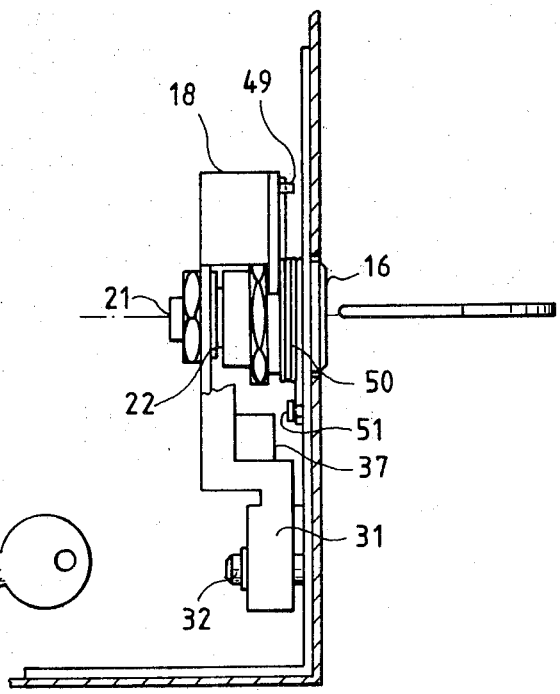
FIG. 5 shows a view of the opening device according to the direction of view 5 shown in FIG. 2.

FIG. 5 shows a top plan view of the arrangement shown in FIG. 4 according to the direction of view V in FIG. 2. Here the operating lever 31 is shown in broken lines in order to clarify further the arrangement of the hook-shaped projection 22 on the closing cylinder 21.

What is claimed is:

1. A lockable cash container suitable for use in combination with but mechanically remote from a cash register or the like comprising:

a generally rectangular box-like casing (12) of oblong configuration having a closed bottom, front, rear and sides and at least a partially open top;

a cover (11) for closing the top of the casing (12);

pivot means (17) defining a pivot axis extending across the width of casing (12) between the front and rear thereof and between the top and bottom thereof for mounting the cover (11) to the casing (12) for pivotal motion between a first stable position flush with and closing the open top and a second stable position which is angularly displaced from the first position and in which the casing top is open and at least a portion of the cover is recessed into the casing;

thrust spring means (42, 43, 44, 45) within the casing (12) for urging the cover (11) toward the second position;

a locking bar (18) pivotally mounted within the casing (12) for rotation between a first locking position in which the bar (18) may be lockingly engaged with the cover (11) and a second unlocking position in which the bar (18) and cover (11) are disengaged;

means (38) biasing the locking bar (18) into the first position;

key lock means (21) mounted within the casing but externally accesible for manually operating the locking bar (18); and electromagnetic means (20) mounted within the casing (12) for remotely electrically operating the locking bar (18).

2. Apparatus as defined in claim 1 wherein the cover (11) further comprises integral flanges (13, 14) extending into the casing (12) parallel to the sides thereof, the pivot means (17) engaging said flanges (13, 14) at points which are substantially spaced from both the bottom and rear of the casing (12).

3. Apparatus as defined in claim 2 wherein the thrust spring means (42, 43, 44, 45) is positioned to engage one of the flanges (13, 14) and the locking bar (18) is positioned to engage the other of the flanges (13, 14).

4. Apparatus as defined in claim 1 further including a cash-holding tray-like insert (15) disposed within the casing (12) but removable therefrom through the open top; and means (31) disposed within the casing (12) for normally holding the locking bar (18) in the second position thereof but responsive to the presence of an insert within the casing (12) to permit normal operation of the locking bar (18).

5. Apparatus as defined in claim 4 further including means (33) biasing the means (31) into engagement with locking bar (18), the bias force provided by means (33) being greater than the bias force provided by means (38).

6. Apparatus as defined in claim 1 wherein the locking bar (18) comprises a portion (27) having a curved camming surface (39), an element (24) mounted on said other of the flanges (13, 14) for camming engagement with the surface (39) when the locking bar (18) is in the first locking position to permit the cover (11) to be closed and locked.

7. Apparatus as defined in claim 1 further comprising leaf spring means (26) mounted on the bottom of the casing (12) to yieldingly engage the portion of the cover (11) which recesses into the casing (12) when the cover is in the open position.

8. A lockable cash container suitable for use in combination with but mechanically remote from a cash register or the like comprising:

a generally rectangular box-like casing (12) having a closed bottom, front, rear, and sides and open top;

a cover (11) for closing the top of the casing (12) and pivotally mounted to the sides of the casing (12) for rotation between a first position which closes the casing (12) and a second position which opens the casing (12) for access to the interior thereof;

thrust spring means (42, 43, 44, 45) within the casing (12) for urging the cover (11) toward the open position;

a locking bar (18) pivotally mounted within the casing (12) for rotation between a first locking position in which the bar (18) lockingly engages with the cover (11) and a second unlocking position in which the bar and cover are disengaged;

means (38) biasing the locking bar (18) into the first position;

key lock means (21) mounted in the casing (12) for manually operating the locking bar (18);

electromagnetic means (20) mounted in the casing (12) for remotely electrically operating the locking bar (18);

a tray-like insert (15) disposed within the casing (12) but removable therefrom through the open top; and means (31) disposed within the casing (12) and normally engaged with the locking bar (18) for holding the locking bar in the second position but responsive to the presence of an insert (15) within the casing (12) to hold the locking bar (18) in the first position.

* * * * *